US006568681B1

(12) United States Patent
Meyer

(10) Patent No.: US 6,568,681 B1
(45) Date of Patent: May 27, 2003

(54) GOLF CARD GAME

(76) Inventor: Michael J. Meyer, 329 Elbo La., Mt. Laurel, NJ (US) 08054

( * ) Notice: Subject to any disclaimer, the term of this patent is extended or adjusted under 35 U.S.C. 154(b) by 0 days.

(21) Appl. No.: 10/053,002

(22) Filed: Jan. 17, 2002

(51) Int. Cl.[7] ..... A63F 1/00

(52) U.S. Cl. ..... 273/298; 273/292; 273/245; 273/293; 273/134

(58) Field of Search ..... 273/292, 293, 273/245, 108.2, 134, 298

(56) References Cited

U.S. PATENT DOCUMENTS

| | | | | | |
|---|---|---|---|---|---|
| 1,597,457 | A | * | 8/1926 | Moorman | 273/296 |
| 1,758,581 | A | * | 3/1930 | Morch | 273/108.2 |
| 2,569,701 | A | * | 10/1951 | Thompson et al. | 273/298 |
| 3,101,947 | A | * | 8/1963 | Dzuris | 273/237 |
| 3,130,973 | A | * | 4/1964 | Zapolski | 273/245 |
| 3,260,526 | A | * | 7/1966 | Seitz | 273/245 |
| 3,658,339 | A | * | 4/1972 | Boileau | 273/245 |
| 3,944,229 | A | * | 3/1976 | Feeney | 273/245 |
| 3,989,249 | A | * | 11/1976 | Breslow | 273/108.2 |
| 4,053,155 | A | * | 10/1977 | Williams | 273/108.21 |
| 4,113,260 | A | * | 9/1978 | Sain | 273/245 |
| 4,126,314 | A | * | 11/1978 | Martin | 273/245 |
| 4,134,590 | A | * | 1/1979 | Conrad | 273/245 |
| 4,176,845 | A | * | 12/1979 | Lancaster | 273/245 |
| 4,277,065 | A | * | 7/1981 | White | 273/245 |
| 4,289,315 | A | * | 9/1981 | O'Barr | 273/298 |
| 4,331,334 | A | * | 5/1982 | Clemmer | 273/245 |
| 4,364,569 | A | * | 12/1982 | Duwell et al. | 273/245 |
| 4,380,338 | A | * | 4/1983 | Lacy | 273/245 |
| 4,546,982 | A | * | 10/1985 | Gaines et al. | 273/298 |
| 4,809,985 | A | * | 3/1989 | Trimble | 273/245 |
| 5,000,460 | A | * | 3/1991 | Barbiaux et al. | 273/245 |
| 5,013,069 | A | * | 5/1991 | Hardin | 283/48.1 |
| 5,234,218 | A | * | 8/1993 | LaRocca | 273/245 |
| 5,273,290 | A | * | 12/1993 | Cole et al. | 273/277 |
| 5,314,208 | A | * | 5/1994 | Strickland | 283/116 |
| 5,358,248 | A | * | 10/1994 | Jankosky | 273/153 J |
| 5,413,349 | A | * | 5/1995 | Canther | 273/245 |
| 5,434,789 | A | * | 7/1995 | Fraker et al. | 473/407 |
| 5,470,077 | A | * | 11/1995 | Brewster et al. | 273/245 |
| 5,497,999 | A | * | 3/1996 | Stewart et al. | 273/298 |
| 5,518,248 | A | * | 5/1996 | Lightfoot | 273/245 |
| 5,692,751 | A | * | 12/1997 | Morrissey et al. | 273/245 |
| 5,720,482 | A | * | 2/1998 | Boudrias | 273/245 |
| 6,386,539 | B1 | * | 5/2002 | Deskovick | 273/153 J |
| 6,412,780 | B1 | * | 7/2002 | Busch | 273/292 |
| 6,419,229 | B1 | * | 7/2002 | Whittington et al. | 273/245 |
| 6,457,713 | B1 | * | 10/2002 | Oppenheimer et al. | 273/245 |

FOREIGN PATENT DOCUMENTS

| | | | | | |
|---|---|---|---|---|---|
| GB | 2 035 100 | A | * | 6/1980 | A63F/3/00 |
| GB | 2 151 145 | A | * | 7/1985 | A63F/3/00 |
| GB | 2 173 410 | A | * | 10/1986 | A63F/7/06 |
| GB | 2 198 651 | A | * | 6/1988 | A63F/3/00 |
| GB | 2 210 274 | A | * | 7/1989 | A63H/3/00 |
| GB | 2 220 147 | A | * | 4/1990 | A63F/3/00 |

OTHER PUBLICATIONS

Pub No. US 2002/0105140 A1—Field, J. E. H.—Aug. 8, 2002.*

* cited by examiner

*Primary Examiner*—Benjamin H. Layno
*Assistant Examiner*—Dolores R. Collins

(57) ABSTRACT

A card game that simulates the game of golf in which the players mutually agree to play a predetermined number of holes. The inventive device comprises a plurality of cards, a plurality of Scoring Conversion Charts, a scoring pad that indicates each hole by number, the par for that hole, and the handicap for same. The inventive device is played with each player being dealt a specific number of cards based on the par for that hole. The player that achieves the lowest golf score for a predetermined number of holes is the winner. Said game can be played on actual golf course scorecards. Most contests and competitions played during an actual round of golf can be established and played with this inventive device.

10 Claims, 3 Drawing Sheets

GOLF CARD GAME

BACKGROUND OF THE INVENTION

1. Field of the Invention

This invention relates to card games that simulate the game of golf and the scoring associated with golf. More specifically, this invention relates to golf games that use playing cards that when played, simulate the game of golf, the scoring associated with the game of golf, and the games and competitions played on an actual golf course.

2. Description of the Related Technology

U.S. Pat. No. 4,546,982 which issued Oct. 15, 1985 to Gaines, et al. illustrates a card game that claims to simulate the game of golf and that utilizes a plurality of cards. This game only resembles golf by the design of the cards and the fact that they call a typical card hand a golf hole. This invention does not take into consideration the par or the handicap for said holes and uses a point system that in no way resembles actual golf scoring.

U.S. Pat. No. 4,289,315, which issued Sep. 15, 1981 to O'Barr, illustrates a card game that simulates the game of golf and utilizes a plurality of decks of cards. This game includes a special tray for allowing each player to have access to the plurality of decks during the game. This patent has been cited to illustrate such game apparatus and the complexity of method of play.

U.S. Pat. No. 4,380,338, which issued Apr. 19, 1983 to Lacy, is a board game that simulates the sport of golf and utilizes actual golf holes with specific pars. According to the disclosure, this game is much less complex than prior games in both construction and use. This patent has been cited to illustrate the use of par as well as the simplicity of the process, however, it does not disclose a card game and does not utilize a conversion chart for the purpose of scoring.

While these devices fulfill their respective, particular objectives and requirements, the aforementioned patents do not disclose a simulated golf card game that provides a competitive, challenging, and simple game for golfers of all abilities as well as non-golfers.

SUMMARY OF THE INVENTION

In view of the foregoing disadvantages inherent in the known types of golf games now present in the prior art, it is therefore the object of the present invention to provide a new playing card game and method for playing same which has many of the advantages of the golf games mentioned heretofore and many novel features that result in a new game which is not anticipated, rendered obvious, suggested, or even applied by any of the prior art golf games, either alone or in any combination thereof.

It is the object of the present invention to provide a new game for simulating the game of golf that enables the players to establish individual and team competitions that are identical to those played on an actual golf course.

It is therefore also an object of the present invention to provide a new playing card game and method for playing the same which has many of the advantages of the golf games mentioned heretofore and many novel features that result in a new game which is not anticipated, rendered obvious, suggested, or even applied by any of the prior art golf games, either alone or in any combination thereof.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

In this respect, before examining at least one embodiment of the invention in detail, it is to be understood that the invention is not limited in its application to the details of construction and to the arrangements of the components set forth in the following description or illustrated in the drawings. Also, it is understood that the phraseology and terminology employed herein are for the purpose of description and should not be regarded as limiting.

BRIEF DESCRIPTION OF THE DRAWINGS

The foregoing and additional objects and advantages of the invention will become more apparent as the following detailed description is read in conjunction with the accompanying drawings.

DETAILED DESCRIPTION OF THE PREFERRED EMBODIMENT(S)

Figure 1:
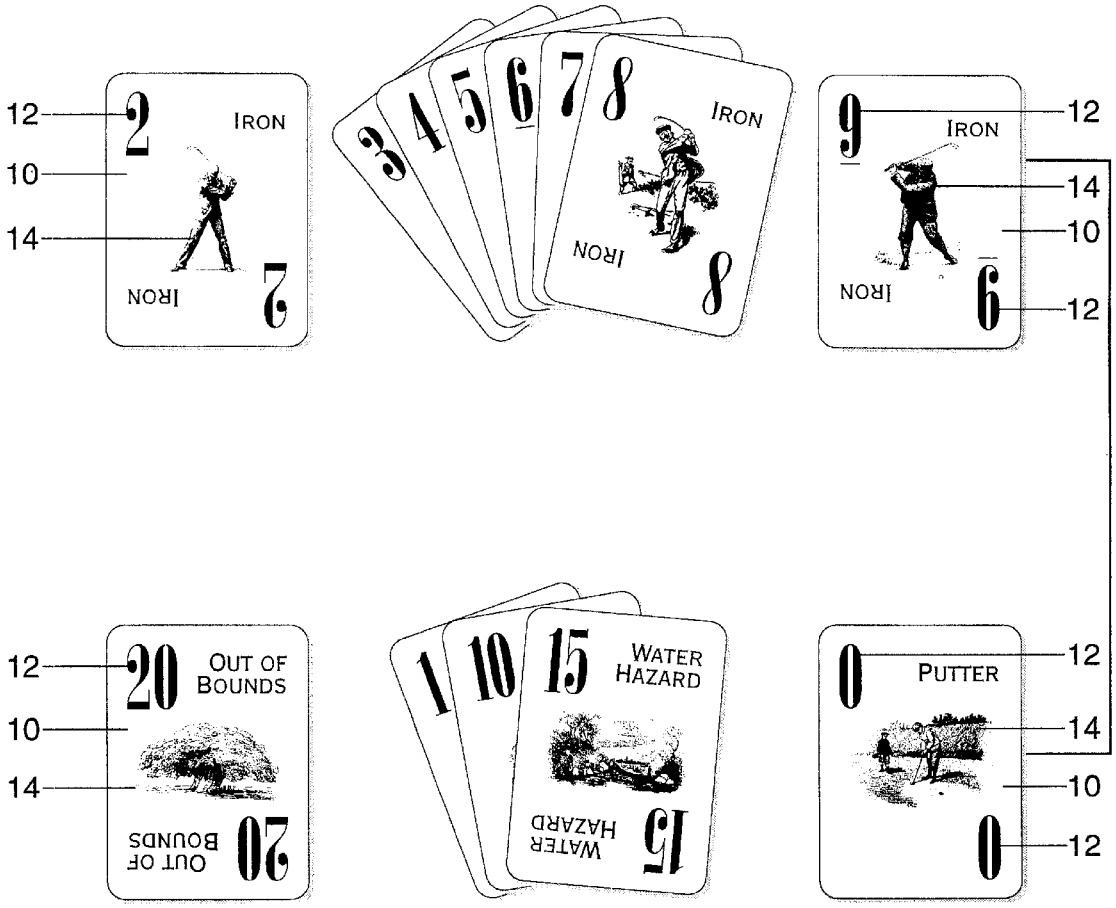
FIG. 1 is an exemplary illustration of the front or portion of the front of each of the plurality of cards contained in a deck of cards that is constructed in accordance with the present invention.

Referring now to the drawings, wherein like reference numerals designate corresponding structure throughout the views, and referring in particular to FIG. 1, shown therein is a view of each of the cards utilized in accordance with this invention. A deck of 52 cards is utilized consisting of a plurality of 13 different cards with a plurality of 13 different point values.

FIG. 1 is an exemplary illustration of the front 10 or portion of the front side 10 of the plurality of cards. The foregoing is considered as illustrative only of the point values 12 of the plurality of cards of the invention. Accordingly, the invention comprises a plurality of cards with a plurality of point values 12 comprising:

Putter with a point value 12 of zero;

Driver with a point value 12 of one;

2 Iron with a point value 12 of two,

3 Iron with a point value 12 of three;

4 Iron with a point value 12 of four;

5 Iron with a point value 12 of five;

6 Iron with a point value 12 of six;

7 Iron with a point value 12 of seven;

8 Iron with a point value 12 of eight;

9 Iron with a point value 12 of three;

Sand wedge with a point value 12 of 10;

Water Hazard with a point value 12 of 15;

Out of Bounds with a point value 12 of 20.

Modifications made to point values 12 can result in different scoring and it is understood that such modifications are intended to fall within the scope of the invention. Furthermore, modifications and suitable equivalents could also occur to the illustration 14 on the face of each card and it is also intended for same to fall within the scope of the invention.

Figure 2:
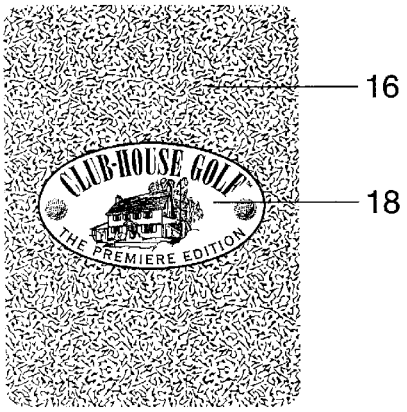
FIG. 2 is an exemplary illustration of the back or common side of the cards of the present invention.

FIG. 2 is an exemplary view of the back 16 or common side of the plurality of cards. The foregoing is considered as illustrative only of the backside that plays no significance in the game. Since numerous modification and changes can readily occur to the illustration 18, and the back 16 it is not intended to limit the invention to the exact illustration 18 or the back 16 as shown.

This back 16 or common side may be conveniently utilized for carrying the trademark, a decorative illustration, or advertisement. Accordingly, modifications and suitable equivalents will occur to the illustration 18 and it is intended for same to fall within the scope of the invention.

Figure 3:
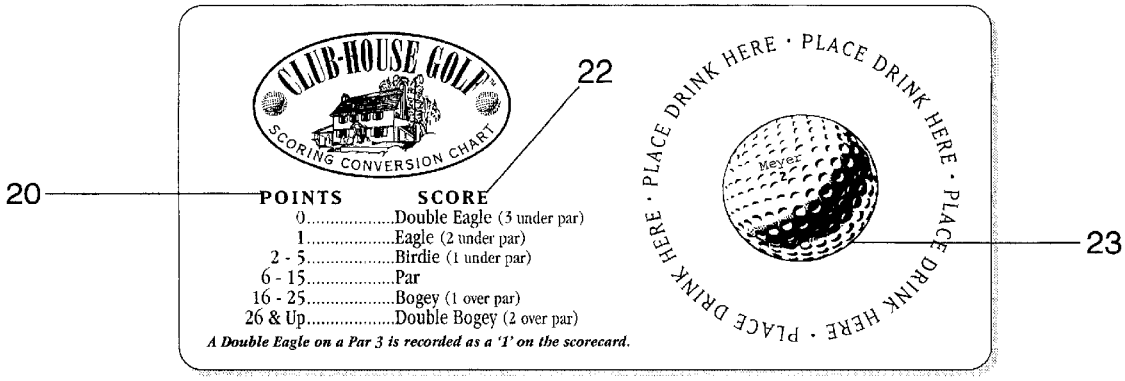
FIG. 3 is an illustration of the Scoring Conversion Chart that is utilized in combination with the deck of cards illustrated in FIG. 1 for converting cards point total achieved to an actual golf score according to the present invention.

FIG. 3 is an illustration of the Scoring Conversion Chart that is utilized to convert each players point total into a golf score based on par. The scoring conversion chart aids in the decision to end the hole and converts each players point total 20 into a golf score 22.

0 points converts to a double eagle;

1 point converts to an eagle;

2 thru 5 points convert to a birdie;

6 thru 15 points convert to a par;

16 thru 25 points convert to a bogey;

26 points and up convert to a double bogey.

Modifications made to point totals 20 as they match up with golf scores 22 can result in different scoring. It is understood that modifications to point total ranges and modifications on how the ranges correspond to golf scores are intended to fall within the scope of the invention.

Furthermore, shape and design of the scoring conversion chart provides protection to horizontal surface. The illustration of the left side 23, is decorative and modifications to the illustration 23 on the scoring conversion chart is also intended to fall within the scope of the invention.

Figure 4:
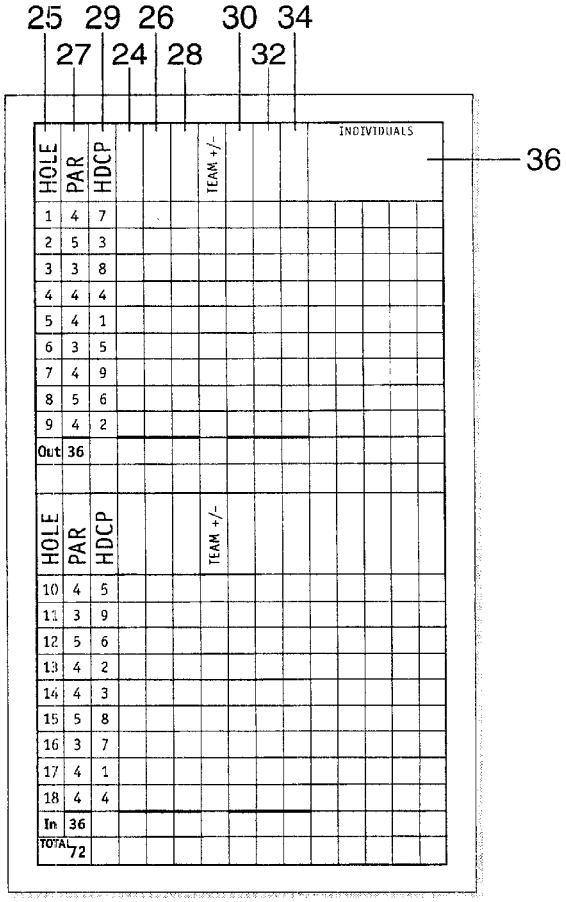
FIG. 4 is an illustration of a scoring sheet that is utilized in combination with the deck of cards illustrated in FIG. 1 as well as in conjunction with the Scoring Conversion Chart as illustrated in FIG. 2 to record said golf scores of the present invention.

FIG. 4 is an illustration of the golf score pad comprising a number of holes 25 with a predetermined par 27 and a predetermined handicap 29 for each hole. Score pad comprises six columns 24,26,28,30,32,34, to accommodate the maximum number of players participating in game. In addition, golf score pad includes space for each player to record any and all individual competitions 36 with other players. This provides a means by which each player can tell at any time while using this invention exactly how he stands with respect to the other players.

Figure 5:
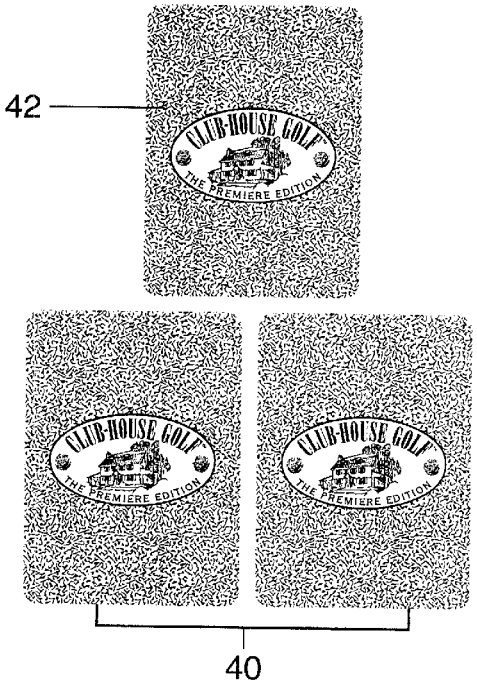
FIG. 5 is an illustration of the way players position their dealt cards on all par 3's.

FIG. 5 is an illustration of the way players are dealt their cards on all par 3's. The number of cards dealt to each player is determined by the par for each hole. Three cards are dealt each player on par 3's. Two lower cards 40 are always positioned side by side with one mystery card 42 positioned above. The lower two cards 40 are peeked at or viewed for a few seconds. The upper card 42 is the mystery card.

Figure 6:
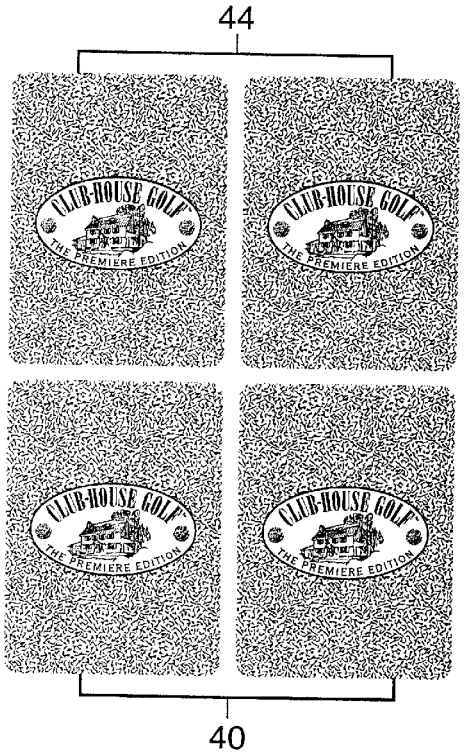
FIG. 6 is an illustration of the way players position their dealt cards on all par 4's.

FIG. 6 is an illustration of the way players are dealt their cards on all par 4's. The number of cards dealt to each player is determined by the par for each hole. Four cards are dealt each player on par 4's. Two lower cards 40 are always positioned side by side with two mystery cards 44 positioned above. The lower two cards 40 are peeked at or viewed for a few seconds. The upper two cards 44 are the mystery cards.

Figure 7:
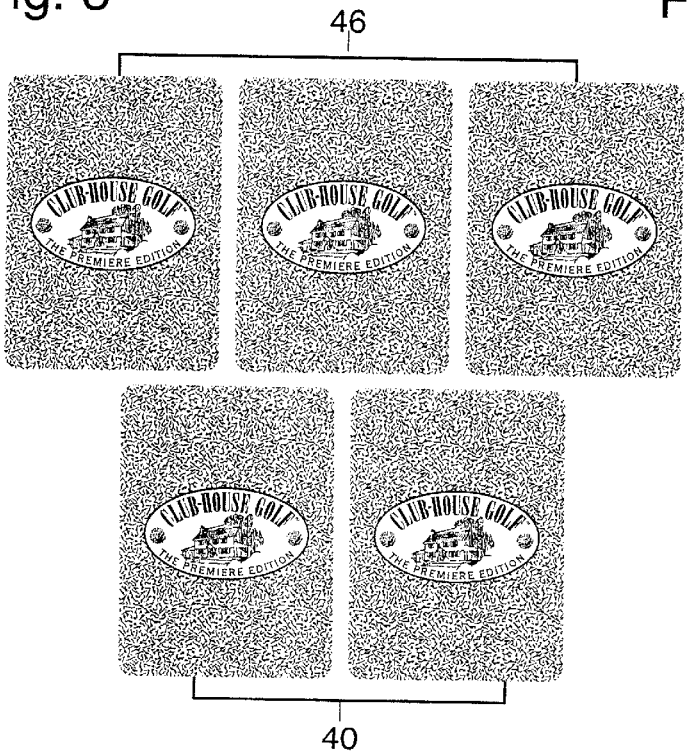
FIG. 7 is an illustration of the way players position their dealt cards on all par 5's.

FIG. 7 is an illustration of the way players are dealt their cards on all par 5's. The number of cards dealt to each player is determined by the par for each hole. Five cards are dealt each player on par 5's. Two lower cards 40 are always positioned side by side with three mystery cards 46 positioned above. The lower two cards 40 are peeked at or viewed for a few seconds. The upper three cards 46 are the mystery cards.

A single game may consist of completing nine holes, eighteen holes, or a complete 72-hole tournament. The player with the lowest score at the end of the predetermined number of holes or the predetermined number of rounds is the winner. Two to six players may play the game although like golf, four players are ideal.

Locate the score pad or select an actual golf course scorecard from your personal collection for recording all players' golf scores. Each of which would indicate the number of holes on the course, the par for each hole and the handicap for each hole. Determine the scorekeeper and have that player record the names of each participating player on the pad or chosen scorecard.

To begin play, each player is provided a Scoring Conversion Chart that is utilized to convert players raw point total into a golf score based on par. This component provides the foundation for this invention and should be successively positioned before each player. Scoring conversion chart quickly and easily converts a raw point total into an actual golf score based on par for each hole. Furthermore, the scoring conversion chart enables each player to determine their current golf score based on their total points whereby providing a means of aiding the decision to end the hole and declare in the cup.

The Par determines how many cards are dealt to each player and the handicap determines the Wild Card that will be worth zero points for that hole. Example: If you are using the score pad, FIG. 4, the first hole is a par 4 and the handicap for the first hole is 7. Therefore each player is dealt four cards, they are positioned as illustrated in FIG. 6, and the card representing the seven iron is wild and worth 0 Points for the first hole only.

The designated dealer deals each player the appropriate number of cards face down according to the par for the hole. Five cards on a par 5, four cards on a par 4, and three cards on par 3's. Players should position their cards in front of them face down. Two cards 40 are always positioned side by side with a predetermined number of cards positioned above. On par threes', one card 42 would be positioned above the two lower cards as illustrated in FIG. 5, on par four's, two cards 44 would be positioned directly above the two lower cards as illustrated in FIG. 6, and on par five's, FIG. 7, three cards 46 would be positioned above the two lower cards The remaining cards are to be used as the draw pile and the top card is turned over to begin the discard pile. The "In The Cup" marker is set beside the discard pile. The in the cup marker is selected by any player on their turn wishing to end the hole.

Continuing, all players must view their own lower two cards at the same time for a predetermined period of time, usually a few seconds. The cards must be set back down in the same position they were and they can't be looked at again or repositioned.

Player to the dealers left is the first to play. This player has the option to select the top card from the draw pile or the top card on the discard pile. The object of each turn is to lower your cards total point value. As stated earlier, the handicap for each hole determines the wildcard for that hole. The wildcard, regardless of face point value becomes worth zero points for that hole.

With the drawn card, the player has three options;

1. Replace one of the two lower cards that have been viewed, if this option is chosen, the player then places the drawn card face down in the exact place of the viewed card and the replaced card is then discarded face up on the discard pile.
2. Take a chance at replacing one of the mystery cards, if this option is chosen, the player then places the drawn card face down in the exact place of the mystery card and the replaced mystery card is then discarded on the discard pile. Once a mystery card is chosen to be replaced and viewed by the player, that mystery card, regardless of point value, must be discarded face up on the discard pile, or
3. Discard the drawn card.

This process continues around the table until a player chooses to end the hole by declaring that they are in the cup. This is done by any player selecting the "In The Cup" marker rather than choosing a card when it is their turn. The scoring conversion chart enables all players to determine their current golf score based on their total point values for means in aiding in the decision to end the hole.

Once a player declares they are in the cup, all the other players have one more turn. The player that ends the hole by declaring "In the Cup" becomes the score to beat and will be rewarded or penalized for their decision to end the hole. If the player that ended the hole by declaring in the cup has the lowest point total of all the other players, he is rewarded by adjusting his golf score one better or one under his achieved golf score. If any player achieves a point total lower than the player that ended the hole and declared in the cup, then the in the cup player is penalized and his golf score is adjusted one worse or one over his achieved golf score.

Once all other players have taken their last turn, the "In the Cup" player reveals their cards and the points are totaled to determine a raw score. This raw score becomes the number to beat and will determine if the "in the cup" players golf score is adjusted. The raw score is then converted into a golf score (par, birdie) using the Scoring Conversion Chart. The in the cup player's score is not recorded on the score card until all other players raw scores are calculated and the adjustment is made.

One by one the other players (in rotation) reveal their cards. Their points are totaled giving them a raw score that is converted to a golf score using the conversion chart. All players scores other than the player that declared in the cup should be recorded immediately.

Once all the opponents' points are totaled and golf scores recorded, the "In the cup" players final adjusted score is determined and recorded. Remember that the point total or raw score determines the adjustment and the adjustment is made to the golf score. (Example: If the combined point score for the player that declared in the cup is 9, utilizing the scoring conversion sheet, a point total of 9 converts to a golf score of Par. If no other opponent has a point total less then 9, the in the cup player's score is adjusted one better or one under and recorded as a birdie. If any of the opponents' point total is less than 9, then the in the cup player's score would be adjusted one worse or one over and recorded as bogey. If any player gets a raw point total of 9, it is considered a tie and there is no adjustment.

All the cards are gathered, reshuffled and the next hole begins. This process continues for a predetermined number of holes and the player with the lowest score after the predetermined number of holes is declared the winner.

A tin storage box is provided for the storage of the plurality of cards, the plurality of scoring conversion charts, the score pad, the "In the Cup" marker and writing utensils. Storage device is constructed in size to accommodate and encourage the collection of actual golf scorecards from around the world.

Thus the reader will see that the invention provides an a new playing card game that simulates golf and provides a fair, competitive, challenging, and simple game for golfers of all abilities as well as non-golfers. This invention also teaches the basics of golf, golf scoring, and increases the non-golfers interest in the game of golf and the friendly competition that often goes along with playing a round of golf.

With respect to the above description, the foregoing is considered as illustrative only of the principles of the invention. Further, since numerous modifications and changes can readily occur, it is not desired to limit the invention to the exact construction and operation shown and described. One of ordinary skill in the art will recognize the adaptability of this game.

Accordingly, all suitable modifications and equivalents that may be resorted to should fall within the scope of the invention. In addition, the game may be adaptable to sports other than golf so long as the sport can be simulated by the creation of a plurality of cards that can be converted to said sports scoring.

The scope of this invention should be determined not by the embodiments illustrated, but by the appended claims and their legal equivalents.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A card game for more than one player that simulates the game of golf, conspiring:

a plurality of cards, each of said cards having at least one predetermined point value;

at least one scoring conversion chart, each of said scoring conversion charts being constructed and arranged converting a raw point total into a golf score;

wherein a first predetermined raw point total converts to a double eagle;

wherein a second predetermined raw point total converts to an eagle;

wherein a third predetermined raw point total converts to an birdie;

wherein a fourth predetermined raw point total converts to an par;

wherein a fifth predetermined raw point total converts to an bogey;

wherein a six predetermined raw point total converts to an double bogey;

wherein a seventh predetermined raw point total converts to an triple bogey;

at least one scoring means for tracking and recording the golf score of each player.

2. A method of playing and scoring a card game that simulates the game of golf, comprising steps of:

(a) selecting a scorecard representing a plurality of golf holes, wherein each hole has a predetermined par value;

(b) dealing each player an appropriate number of cards that is determined by the par value for the hole, but at least one of the cards being hidden from view from the players as a hole card, each of said cards having at least one predetermined point value;

(c) establishing a stock pile and a discard pile with the remaining cards;

(d) beginning by having all players view their hole card(s);

(e) rotating turns as players choose to draw from the stock pile or from the discard pile;

(f) permitting each player to selectively utilize the drawn card to replace a dealt card in an attempt to lower ones point total;

(g) continuing this process around the table until a player chooses to end the hole by making a declaration;

(h) allowing each of the other players to complete one more turn;

(i) totaling each of the other players cards point value to determine a raw score;

(j) converting the raw score into a golf score;

(k) recording the golf score on the score card.

3. A method of playing and scoring a card game according to claim 2, further comprising a step of designating one card as a wild-card in which the player may designate the point value of the wild-card.

4. A method of playing and scoring a card game according to claim 3, wherein the scorecard further has handicap information provided thereon, and wherein said step of designating one card as a wild-card is performed by referring to the handicap information.

5. A method of playing and scoring a card game according to claim 2, further comprising repeating steps (a) through (k) in order to complete player of an entire golf course that is indicated on the scorecard.

6. A method of playing and scoring the card game according to claim 2, wherein step (b) is performed by dealing five cards to each player on a par 5, four cards to each player on a par 4, and three cards to each player on par 3's.

7. A method of playing and scoring the card game according to claim 2 wherein step (g) is performed by any player choosing to end the hole and declare "in the cup" when it is their turn thereby allowing the other players one last turn.

8. A method of playing and scoring a card game according to claim 2 wherein step (j) is performed by converting a raw score on a particular golf hole into a golf score utilizing a scoring conversion chart for a plurality of players.

9. A method of playing and scoring a card game according to claim 8, wherein the method of converting each player's raw score into a golf score comprises using a range of points to correspond to an actual golf score as it relates to par.

10. A method of playing and scoring a card game according to claim 2, wherein step (a) is performed with a scorecard from an actual golf course.

* * * * *